US005688187A

United States Patent [19]

Duncan

[11] Patent Number: 5,688,187

[45] Date of Patent: Nov. 18, 1997

[54] GOLF IRONS

[76] Inventor: Ross A. Duncan, 17 Hi Luci, Ave., Mount Prospect, Ill. 60056

[21] Appl. No.: 781,238

[22] Filed: Jan. 10, 1997

[51] Int. Cl.[6] ..... A63B 53/04; A63B 53/02

[52] U.S. Cl. ..... 473/305; 473/314; 473/350

[58] Field of Search ..... 473/313, 314, 473/305, 324, 329, 330, 342, 345, 344, 350, 282, 316, 256, 236, 226, 219, 293, 331

[56] References Cited

U.S. PATENT DOCUMENTS

D. 216,031 11/1969 Blake .
669,864 3/1901 Simpson .
1,250,296 12/1917 Fitzjohn ..... 473/313
1,705,250 3/1929 Hincks .
2,231,847 2/1941 Dickson ..... 473/306
3,539,184 11/1970 Koorland .
3,967,826 7/1976 Judice ..... 473/313
4,632,400 12/1986 Boone ..... 473/305
4,650,191 3/1987 Mills .
5,377,985 1/1995 Ohnishi ..... 473/324

*Primary Examiner*—Sabastiano Passaniti
*Attorney, Agent, or Firm*—Don Moyer

[57] ABSTRACT

New golf irons have the shaft attached into the club head directly through the club face, which allows the club face to be generally symmetrical in order to ease alignment of the club for hitting, to reduce moments of inertia which could turn the club face to spoil a hit, and to enlarge the area for best hitting.

7 Claims, 1 Drawing Sheet

GOLF IRONS

BACKGROUND

This invention is a new form for golf irons with the shaft attached to the club head directly through the club face, which allows the club face to be generally symmetrical.

One goal of golf iron design is to maximize the opportunity for a golfer to hit a golf ball so that the ball will land where the golfer intended for the ball to land. This can be approached by several strategies. One strategy is to reduce factors which lead to poor initial alignment and which lead to turning the club face thereby changing the alignment to spoil a hit. Another strategy is to maximize the area of the club face from which the ball can be best hit, for example by enlarging the club head.

In conventional golf iron design the club toe is larger than the club heel in order to offset the mass of the neck into which the shaft is attached. This leads to misalignment and turning problems. Because the toe must be larger than the heel, when the club face is viewed by a golfer gripping the club shaft with the club and ball in normal address position, then the top line of the club seen by the golfer and the sole of the club seen by the golfer are not parallel. This creates an ambiguity regarding which part of the club face should be aligned perpendicular to the intended path of the ball and misalignment commonly results.

A conventional design club must have mass at the toe to counter balance the mass of the neck in order to minimize moments of inertia which could turn the club as the ball is hit and spoil the hit. This means that there is a moment of inertia of the club head about the shaft axis which can turn the club face away from the intended alignment during the swing and spoil the hit. When the club is enlarged to increase the area for best hitting, then the moment arm of the toe mass is increased which increases the chance that the club face will turn to spoil a hit. Conversely, reducing the moment arm of the toe mass decreases the area for best hitting.

These problems can be solved by attaching the shaft to the club directly through the club face. There is no neck to counter balance. The club can be generally symmetric with the toe and heel having the same size. When viewed by a golfer gripping the club shaft with the club and ball in normal address position there is no ambiguity, because all parts of the club face appear parallel, so that alignment of the club face perpendicular to the intended path of the ball is eased. The area for best hitting is larger, and the club is more compact. Greater compactness reduces the mass away from the shaft and reduces the moment arm of the mass away from the shaft so that there is less chance that the club face will turn away from the intended alignment. Schemes for distributing the mass of the back of the club head to enlarge the area for best hitting and to reduce turning moments are facilitated by the symmetric club head. And, this design can be consistent with the rules of golf as established by the United States Golf Association and the Royal and Ancient Golf Club of St. Andrews.

In U.S. Pat. No. 1,250,296 Fitzjohn shows a shaft attached to the back of a golf iron club head. To make this club consistent with the rules of golf—which require that the distance between the shaft axis and a reference line which is tangent to the club heel and which is parallel to the shaft axis be no greater than 0.625 inches (16 mm)—would introduce moments of inertia at least as large as in conventional clubs. In U.S. Pat. No. 2,231,847 Dickson proposes to reduce the mass of the hosel to enlarge the area for best hitting. The neck is retained however which keeps the toe larger than the heel and keeps large turning moments. Boon shows a reduced mass neck in U.S. Pat. No. 4,632,400, but this club is still far from symmetric.

Various schemes have been proposed for distributing the mass of the back of the club head, in order to reduce turning moments and in order to increase the size of the area for best hitting, such as that of Ohnishi in U.S. Pat. No. 5,377,985. Because these club heads are still not symmetric the results of these schemes are limited.

The rules of golf allow greater flexibility in the design of putters and there are many designs intended to reduce factors which might turn the head away from the desired alignment and to make it easier to align and swing the club. In U.S. Pat. No. 3,967,826 Judice shows a shaft attached to the club head through the face. Here the shaft is bent so that the axis of the gripped portion of the shaft passes through the center of the ball and thereby does not conform to the rules of golf which set limits on the position of the shaft axis for golf irons. The rules of golf also require that golf irons have a straight shaft so that this putter design will not conform to the rules of golf on two counts.

SUMMARY

Objects of this invention include the following. Make new golf irons in which the shaft is attached to the club head directly through the face. Make a golf iron club head which is generally symmetrical. Make a generally symmetrical golf iron club head which, when viewed by a golfer gripping the shaft with the club and ball in normal address position, will be easy to align perpendicularly to the intended path of the ball. Make a generally symmetrical golf iron club head which is more compact and has a larger area for best hitting than a conventional golf iron. Make a generally symmetrical golf iron club head which minimizes the distance between the shaft axis and the center of the area for best hitting. Make a generally symmetrical golf iron club head which has a mass distribution which maximizes the area for best hitting. Make a generally symmetrical golf iron club head which has a mass distribution which minimizes moments of inertia in order to decrease the chance that the club head will turn to spoil a hit. Make a golf iron having a shaft axis such that a golfers hands gripping the shaft are ahead of the golfer's line of sight to the ball in normal address position, which eases alignment of the face relative to the ball. Make new golf irons which are consistent with the rules of golf.

In Summary, one embodiment of this invention is a golf iron having a shaft attached into the club head directly through the club face, the club head being generally symmetrical with height of the heel and the toe being generally equal.

Other equivalent embodiments will be comprehended in the drawings and the detailed description, which will make additional equivalent embodiments obvious hereafter to persons skilled in the art.

DRAWINGS

DETAILED DESCRIPTION

Figure 1:
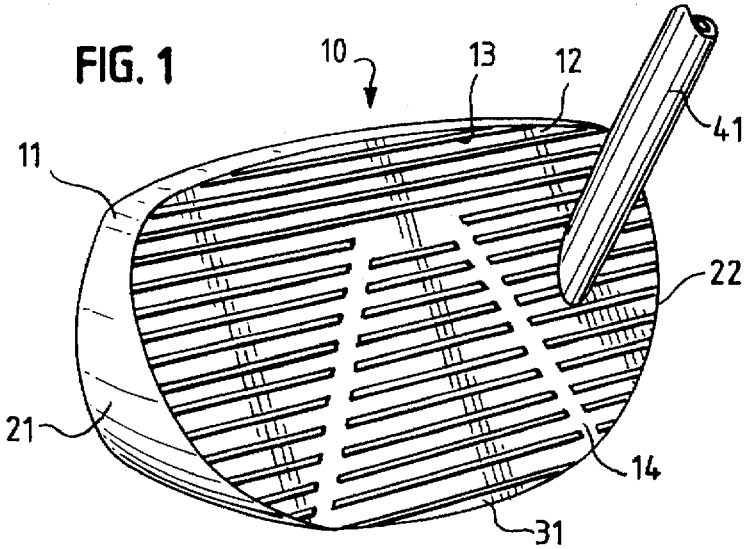
FIG. 1 is a perspective view of the golf iron club head and a portion of the shaft.
Figure 2:
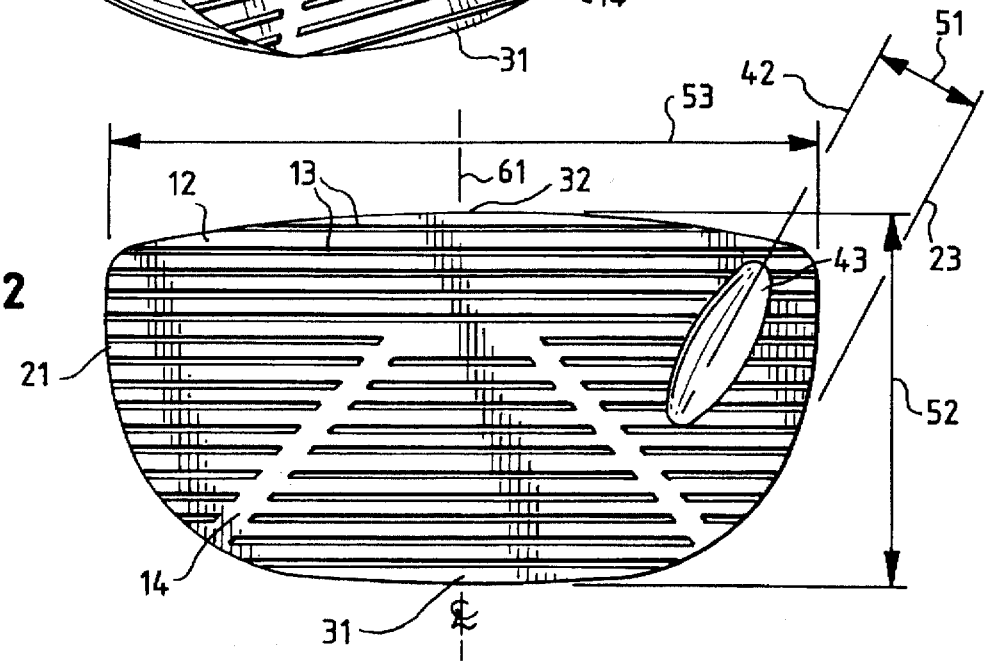
FIG. 2 is a front view of the club head.
Figure 3:
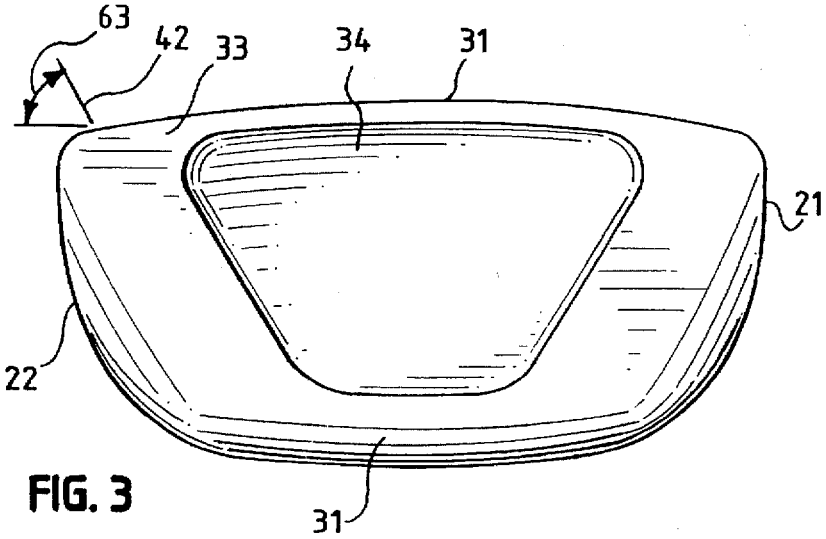
FIG. 3 is a back view of the club head.
Figure 4:
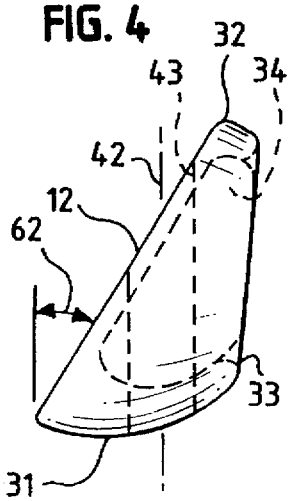
FIG. 4 is a side view of the club head.

A new golf iron 10 is shown in FIG. 1. The golf iron has a club head 11 which has a face 12. The face has grooves 13 extending into the face and has an alignment guide 14 formed by the absence of groves. The club face is bounded by a periphery with a toe 21, a heel 22, a sole 31 and a top line 32. The club head also has a back 33 bounded by the same periphery. There is a cavity 34 in the back—best seen in FIG. 3 and FIG. 4.

There is a socket 43 opening out of the face and extending into the club head toward the back. A generally straight shaft 41 is attached into this socket. The end of the shaft away from the club which is gripped by a golfer is not different from conventional club design and is not shown. An axis 42 extends fully along the center of the generally straight shaft. This axis 42 is a distance 51 from a line 23 which is tangent to the heel 22 and is parallel to the axis 42. The distance 51 is required to be no greater than 0.625 inches (16 mm) by the current rules of golf established by the United States Golf Association and the Royal and Ancient Golf Club of St. Andrews.

The preferred form of the new golf irons conforms to the rules of golf for golf irons. Equivalent forms of the new golf irons can be made which do not conform to the current rules of golf.

The golf iron shown in the figures is a six iron. The other irons—from the one iron to the nine iron, the pitching wedge iron, and the sand wedge iron—differ mainly by the loft angle 62 between the plane of the face and a vertical plane when the club is in normal address position. These several irons can also differ by the distance 53 between the heel and the toe, by the distance 52 between the sole and the top line, by the lie angle 63 between the shaft axis 42 and a horizontal line, and by the curvatures of the sole and the top line.

Because all of the new golf irons have the shaft attached into the socket in the club head directly through the face, all the new golf iron club faces can be—and in the preferred form are—generally symmetrical about a center line 61 which is located equidistant between the extremities of the toe and the heel, half way along the distance 53. This means that the periphery on the toe side of the center line is generally a geometric reflection of the periphery on the heel side of the center line and that the height at the heel 52 is generally the same as the height at the toe. The generally symmetric form leads to several key benefits.

In normal address position a golfer grips the end of the shaft away from the club head and holds the club face at and aligned with the golf ball such that the club face is perpendicular to path along which the ball is intended to be hit. With a generally symmetric club face the top line 32 of the club face and the sole 31 of the club face are seen to be parallel by a golfer in normal address position. The shaft can be attached into the club face so that the golfer's hands are ahead of the golfer's line of sight to the ball in normal address position further easing alignment.

The distance 53 is less than for a conventional design golf iron making the club head more compact. The distribution of mass relative to the area of best hitting is better balanced than for a conventional club so that the chance of the club head turning during a hit to spoil the hit are reduced. The mass away from to the shaft axis is less than for a conventional club so that the chance that the club head will turn during the swing to spoil a hit are reduced.

In the dynamics of hitting a golf ball with a golf iron it is found that there is a club face area for best hitting, such that a golf ball hit from within this area is most likely to follow the intended path, whereas a golf ball hit from outside this area is least likely to follow the intended path. The area for best hitting is sometimes called a "sweet spot." Even though the distance 53 is less than for a conventional design golf iron, the area for best hitting on the symmetrical club face is larger than for the conventional design club. And, the area of the face from which the ball can be hit at all is larger than for a conventional design golf iron.

Various schemes using cavities in the golf club back and distributing mass around and within the cavity have been used to enlarge the area for best hitting. Such schemes are facilitated by the attachment of the shaft and the generally symmetrical form of the new golf iron.

To help a golfer align the club face perpendicular to the intended path and so that the ball will be hit from within the area of best hitting, an alignment guide is provided on the club face. The generally symmetric club face opens new opportunities for various alignment guides such as the arrow-like guide shown.

Other equivalent forms for the alignment guide, the club face, and the club head and other equivalent configurations of the shaft and the club head, will be obvious hereafter to persons skilled in the art. It is understood therefore that this invention is not limited to the particular examples illustrated here.

I claim:

1. A golf iron comprising:

a club head, the club head having a face and a back, the face and the back being bounded by a common periphery, the periphery comprising a heel, a sole, a top line, and a toe, the face being generally in a plane, the plane being at an acute angle relative to a vertical plane when the club head is in normal address position;

a socket in the club head, the socket opening out of the face, the socket extending toward the back; and a shaft, the shaft being attached to the club head directly through the face into the socket, the shaft being generally straight, and the shaft having an axis centered in the shaft and extending fully along the shaft.

2. The golf iron of claim 1 wherein the shaft axis is no more than 0.625 inches (16 mm) distant from a reference line which is tangent to the heel and parallel to the shaft axis.

3. The golf iron of claim 1 wherein the club head is generally symmetric about a center line located equidistant between the heel and the toe.

4. The golf iron of claim 1 wherein there is a cavity in the back, the cavity providing means for distributing club mass in order to enlarge an area on the club face for best hitting.

5. The golf iron of claim 3 wherein the sole and the top line appear parallel when viewed by a golfer holding the shaft with the club head in normal address position.

6. The golf iron of claim 3 wherein there are grooves in the club face.

7. The golf iron of claim 3 wherein there is an alignment guide on the club face.

* * * * *